US009068357B2

(12) United States Patent
Duernberger

(10) Patent No.: US 9,068,357 B2
(45) Date of Patent: Jun. 30, 2015

(54) TURNING PROFILE

(75) Inventor: Gerhard Duernberger, Strasswalchen (AT)

(73) Assignee: Kaindl Flooring GMBH, Wals/Salzburg (AT)

( * ) Notice: Subject to any disclaimer, the term of this patent is extended or adjusted under 35 U.S.C. 154(b) by 2475 days.

(21) Appl. No.: 10/596,992

(22) PCT Filed: Nov. 2, 2004

(86) PCT No.: PCT/EP2004/052749
§ 371 (c)(1),
(2), (4) Date: Jul. 5, 2006

(87) PCT Pub. No.: WO2005/066432
PCT Pub. Date: Jul. 21, 2005

(65) Prior Publication Data

US 2007/0107361 A1 May 17, 2007

(30) Foreign Application Priority Data

Jan. 6, 2004 (DE) ..... 20 2004 000084 U

(51) Int. Cl.
*E04B 2/00* (2006.01)
*E04F 13/08* (2006.01)
*E04F 15/02* (2006.01)

(52) U.S. Cl.
CPC ..... *E04F 13/08* (2013.01); *E04F 2201/043* (2013.01); *E04F 15/02* (2013.01); *E04F 2201/0153* (2013.01); *E04F 2201/05* (2013.01)

(58) Field of Classification Search
CPC ..... E04F 13/08; E04F 15/02; E04F 2201/043; E04F 2201/0153; E04F 2201/05
USPC ..... 52/592.1, 592.4, 591.1, 591.4, 591.5, 52/592.2, 589.1, 586.1, 582.1; 428/192
See application file for complete search history.

(56) References Cited

U.S. PATENT DOCUMENTS

| | | | | |
|---|---|---|---|---|
| 1,776,188 | A * | 9/1930 | Langbaum | 52/592.4 |
| 4,037,377 | A * | 7/1977 | Howell et al. | 52/309.9 |
| 6,505,452 | B1 * | 1/2003 | Hannig et al. | 52/582.1 |
| 6,546,687 | B2 * | 4/2003 | Oh et al. | 52/409 |
| 6,647,690 | B1 * | 11/2003 | Martensson | 52/601 |
| 7,121,058 | B2 * | 10/2006 | Palsson et al. | 52/592.2 |
| 7,150,135 | B2 * | 12/2006 | Becker | 52/592.1 |
| 2003/0024199 | A1 * | 2/2003 | Pervan et al. | 52/589.1 |
| 2003/0177730 | A1 * | 9/2003 | Bloomfield | 52/592.1 |
| 2003/0196405 | A1 * | 10/2003 | Pervan | 52/592.1 |
| 2004/0211143 | A1 * | 10/2004 | Hanning | 52/578 |

FOREIGN PATENT DOCUMENTS

| | | |
|---|---|---|
| AT | 405 560 B | 9/1999 |
| DE | 3619046 | 12/1987 |

(Continued)

OTHER PUBLICATIONS

Gilbert Townsend, S.B.: "Carpentry", 1945, American Technical Society, Chicago, U.S.A., p. 82.

*Primary Examiner* — Adriana Figueroa
(74) *Attorney, Agent, or Firm* — Renner, Otto, Boisselle & Sklar, LLP

(57) ABSTRACT

The invention relates to mechanical connecting means, in particular for panels, which can be connected together in a positive fit in two spatial directions which are perpendicular to each other.

15 Claims, 4 Drawing Sheets

(56) References Cited

FOREIGN PATENT DOCUMENTS

| | | | |
|---|---|---|---|
| DE | 299 17 947 | U1 | 4/2000 |
| DE | 20206751 | | 8/2002 |
| EP | 0969163 | | 1/2000 |
| WO | 01/02671 | A1 | 1/2001 |
| WO | WO 0102669 | A1 * | 1/2001 |
| WO | 01/48332 | A1 | 7/2001 |
| WO | WO 03016654 | A1 * | 2/2003 |

* cited by examiner 1
2
3
4
5
6
7
8
9
10
11
12
13

TURNING PROFILE

This application is a national phase of International Application No. PCT/EP2004/052749 filed Nov. 2, 2004 and published in the German language.

FIELD OF THE INVENTION

The invention relates to mechanical connecting means, in particular for panels, which can be connected with each other in a positive fit in two spatial directions that are perpendicular to each other. Such a connecting means for panels is known from DE 20206751 U1.

BACKGROUND AND SUMMARY OF THE INVENTION

Figures 1A, 1B, 1C:
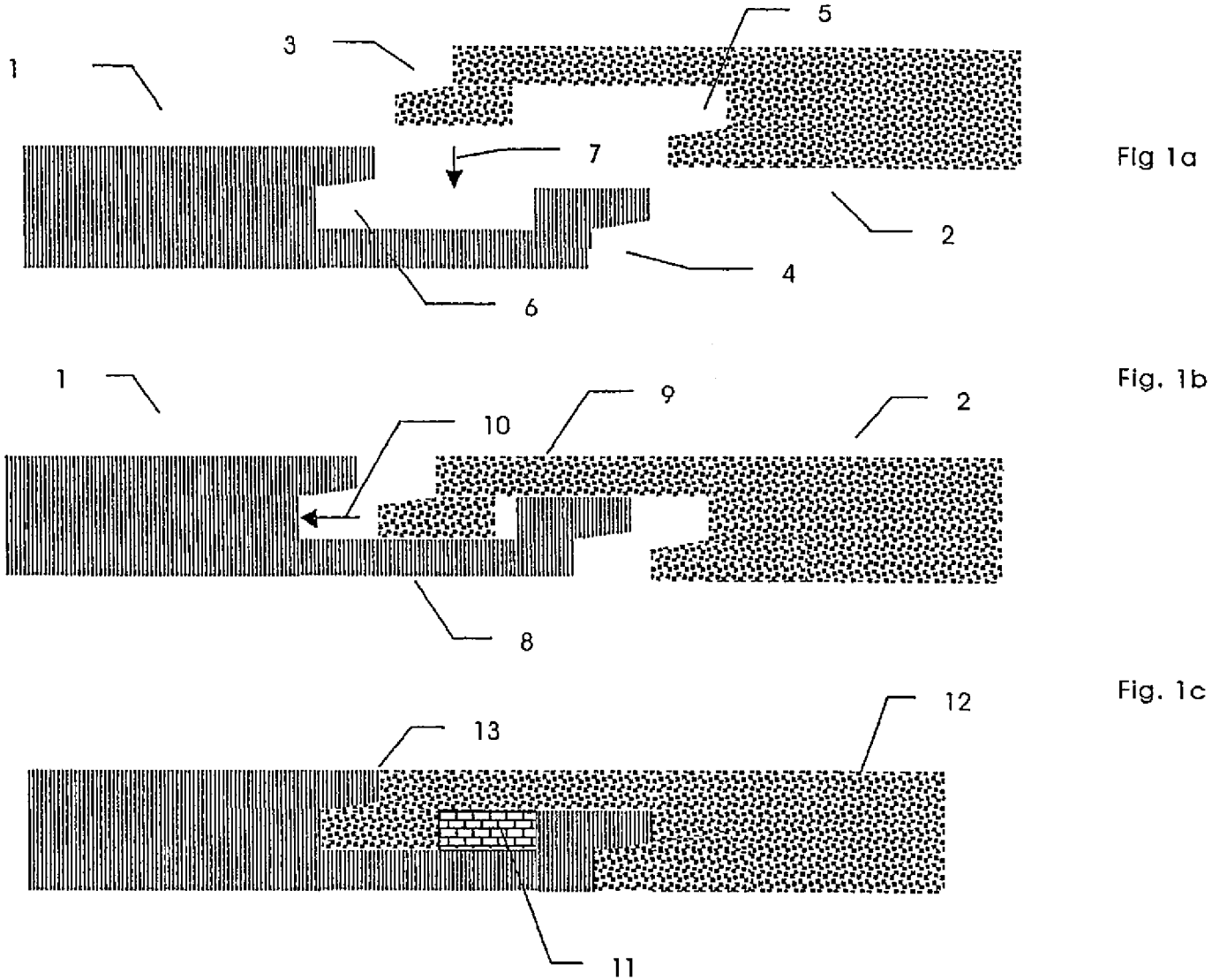
FIG. 1*a* illustrates a first embodiment with two panels having connecting means that are the same geometrically.
FIG. 1*b* illustrates the first embodiment with two panels having connecting means that are the same geometrically.
FIG. 1*c* illustrates the first embodiment with two panels having connecting means that are the same geometrically.

A panel is a rectangular or square board that is laterally provided with mechanical connecting means, such as groove and tongue. Several panels may be assembled to form a covering. The covering may be provided for floorings, ceilings or walls.

A panel consists, for example, of plastics, wood, or of a layer structure in which the individual layers may consist of different materials such as wood, derived timber products, paper, stone, etc.

DETAILED DESCRIPTION

Panels that are used as covering preferably have a décor on their surface. The décor may be provided by printed paper or a layer of wood or stone. This decorative layer is preferably applied to a base board. Currently, the base board typically consists of a derived timber product, particularly preferably of HDF or MDF, since this derived timber product is relatively stable dimensionally, has a smooth surface, and because complex geometries may be milled in. As a rule, a transparent wear-resistant layer is disposed above the décor, in particular, when the decorative layer consists of delicate materials such as paper or wood.

Examples for the configuration of such a wear-resistant layer are mentioned in DE 299 17 947 U1. According to this, the wear-resistant layer comprises wear-resistant particles that may consist of corundum or silicon carbide and are embedded in a resin layer. Such a wear-resistant layer is provided especially in cases where the covering is to serve as a floor covering. Because in a flooring, importance must be attached to special wear-resistance. In addition, such a wear-resistant layer is, as a rule, water-repellent and is less susceptible with regard to water compared to the layer underneath it, or the decorative layer. The water repellent properties are, as a rule, obtained by means of the resin which may be a component of the wear-resistant layer. The water-repellent properties of the wear-resistant layer are also particularly desirable in a floor covering, since it is regularly subjected to moisture by mopping, among other things.

Preferable embodiments of the present invention comprise one or several features of the aforementioned examples.

Panels with mechanical connecting means of the type mentioned at the beginning may be connected with each other without the use of adhesives by pushing them towards each other in a plane so that finally, they engage each other ("pushing solution"). Panels of that kind are described in AT 405 560 B. Though the interlock is subsequently particularly good, as far as the direction perpendicular to the surface of the covering formed by the panels is concerned, the interlock is relatively weak as far as the interlock in the direction opposite to the pushing direction is concerned. The panels may disengage unintentionally; in particular, when the covering formed by the panels is used as flooring and is thus subjected to particularly large mechanical stresses. Furthermore, the connection process by pushing requires a relatively large effort.

A connection which is, as a rule, mechanically more stable compared to this is disclosed by printed publication WO 01/02671A1, in which two rectangular panels can be connected with each other by turning ("turning solution"). The effort required for establishing a connection is smaller as compared to the aforementioned pushing solution, because, on the one hand, a leverage is exploited, and on the other hand, locking means need not be elastically deflected, or only to an insignificant degree, because an engaging effect can be done without. However, handling when connecting is relatively problematic when two or more panels are already connected with each other at the narrow sides and when, in a united state, they are now to be connected at the long sides with panels that have already been laid.

Though it is proposed, according to FIG. 8 of WO 01/02671 A1, to exploit elastic properties of a panel in order to make this handling easier, this, however, presupposes sufficient elastic properties of the panel bodies, which in many cases is not given. Furthermore, handling is still relatively complicated.

According to printed publication WO 01/48332 A1, connecting means are therefore proposed for flooring panels that preferably make a connection by turning at the long sides of rectangular panels possible. In the two spatial directions that are relevant in a floor covering, this connection at the long sides is detachable only by destroying the connecting means. The narrow sides are provided with locking means that make a connection by pushing in one plane possible (pushing solution).

If two panels have already been connected by turning to a third panel with their long sides, then the two panels are pushed towards each other until the connecting means engage each other at the narrow sides and are then connected with each other in a positive fit. Such panels may be easier to lay compared to panels in which all sides must be connected with each other by turning. However, the connections at the narrow sides may open up again unintentionally, because the narrow sides are comparatively weakly interlocked. In addition, pushing requires a relatively large effort because relatively large friction forces must be overcome due to the long sides being connected.

In order to avoid the above-mentioned pushing that takes a lot of effort, it is proposed, according to DE 202 06 751 U1, to design the narrow sides of the connecting means in such a way that panels can substantially be connected with each other in a positive fit by lowering them (lowering solution). Thus, a panel can be connected, with its long side by turning and with its narrow side by lowering, to panels that have already been laid in this manner. On the narrow sides, the connecting means may be configured in such a way as to engage each other. This laying procedure is much faster and simpler compared to the aforementioned solutions. As a rule, the joints between the panels at the narrow sides cannot open up unintentionally by pushing in a parallel direction relative to the surface of the covering formed by the panels. However, in the case of strain or due to bumps in the subsurface, a kind of step may arise at a narrow side, because, as a rule, the interlock perpendicular to the flooring surface is relatively weak. In addition, the geometries are very fragile, as a rule, and may easily break.

The aforementioned connecting means known from the art additionally have the disadvantage that different geometries must be produced. As a rule, this requires different molds or different milling heads and/or milling processes. Accordingly, the manufacturing methods require much effort and are expensive.

In view of this, it is the object of the invention to avoid one or more of the aforementioned disadvantages of a connecting means.

The object of the invention is achieved by a connecting means having the features of the first claim. Advantageous embodiments result from the dependent claims.

In a preferred embodiment, the connecting means is formed so that it can be interlocked in a positive fit with a further connecting means that has entirely or mostly the same geometry. Therefore, only one geometry has to be manufactured. Thus, the number of tools required for manufacturing the connecting means can be minimized.

In a further advantageous embodiment, the connecting means is formed so that it can be interlocked with a further connecting means within the sense of the invention by first lowering the one connecting means relative to the other panel. When it has been lowered, there is a positive interlock in a first direction, namely in a perpendicular direction relative to the direction of lowering. Then, the one connecting means is pushed towards the other, resulting in an interlock in a second spatial direction, namely in a perpendicular direction relative to the direction of pushing. On the one hand, the connecting process is easily handled, particularly even when the connecting means serves for connecting panels of the type mentioned at the beginning. On the other hand, a particularly stable connection can thus be provided that is particularly advantageous for floor coverings.

In a further advantageous embodiment, the connecting means is formed so that it can be interlocked with a further connecting means within the sense according to the invention by first lowering the one connecting means relative to the other panel. When it has been lowered, there is a positive coupling in a first direction, namely in a perpendicular direction relative to the direction of lowering. Then, the one connecting means is pushed towards the other. There is then a positive coupling in a second direction, namely in a perpendicular direction relative to the pushing direction. This results in a channel formed by the two connecting means. An adapted separate locking means is then pushed into the channel. The connecting means are then interlocked.

The separate locking means preferably is a securing pin, because this works particularly reliably and because a pin-like element is commercially available. Thus, no specific production must be provided for the securing pin.

In the embodiment including the separate locking means, the connecting means are interlocked better compared to the embodiment in which interlocking takes places only by lowering and subsequent pushing. A connection can also be made in a way that puts little stress on the material, because compressive forces, shear forces and splitting forces can be avoided.

The separate locking means, i.e., for example, the securing pin, preferably consists of a material such as plastics or metal which has a smooth surface and can therefore be easily pushed into the channel. Plastics has the further advantage that the material can be compressed slightly so that pushing it into the channel is facilitated. A press fit in the channel can also be realized, in particular in order to be able to elastically compensate for expansion phenomena and thus avoid an unintentional opening of the joint between the connecting means.

It is preferred that the mentioned press fit of the separate locking means substantially only counter-acts the spatial direction in which the connecting means were pushed together last. On the one hand, it is thus ensured that the joints cannot open unintentionally. On the other hand, it is avoided that the friction forces that must be overcome in order to push the separate connecting means into the channel become unnecessarily large.

Preferably, the separate connecting means has a rectangular or at least substantially rectangular cross-section with a longer and a narrower side. The longer side is then located in the channel parallel to the direction in which the connecting means were last pushed towards each other last. This makes it possible, on the one hand, to provide a particularly stable interlock, and on the other hand, to minimize the volume that the connecting means occupy. If the separate connecting means consist of an elastic material, then expansion and shrinking phenomena that have an effect in the shifting direction may additionally be compensated particularly well because the compressibility of a material increases when the thickness of the material increases. This is particularly advantageous where the connecting means serve the purpose of connecting panels. In this case, expansion phenomena in the pushing direction are, as a rule, particularly problematic.

Preferably, a connecting means is formed substantially step-shaped or stair-shaped and/or has a recess corresponding thereto. By this step-shape or stair-shape, it is achieved that the interlocks are particularly firm in the desired two spatial directions because then, the respective interlock is obtained by means of surfaces that run perpendicularly thereto.

The lowermost step tapers a little, preferably towards the open end, so that it can be easily inserted in the corresponding recess. Alternatively or additionally, the recess can increase in size towards the outside in order to facilitate assembly. This has the additional advantage that it can thus be ensured that the step is finally disposed in the corresponding recess without play.

Additional advantages and embodiments result from the embodiments mentioned hereafter.

The FIGS. 1*a* to 1*c* illustrate a first embodiment of the invention. Two panels 1 and 2 have connecting means on their sides that are the same geometrically, which makes their manufacture less expensive. The connecting means have step-shaped locking means 3 and 4 as well as recesses 5 and 6 corresponding thereto.

In relation to panel 1, the panel 2 is placed such that the connecting means of the panel 2 are suitably disposed above connecting means of the panel 1, as FIG. 1*a* illustrates. Then, the panel 2 is lowered along the arrow 7 until the step-shaped locking element 3 comes to rest, with its underside, on the protruding flank or groove wall 8 of the panel 1. At the same time, the locking element 4 comes to rest at the protruding upper flank or groove wall 9 of the panel 2, as FIG. 1*b* illustrates. Now, the panels cannot be arbitrarily pulled apart along the arrow 10. Thus, the panels are coupled with each other in a direction perpendicular relative to the lowering direction.

Now, the panel 2 is pushed along the arrow 10 in the direction of the panel 1. In this manner, the step-shaped locking means 3 arrives in the corresponding recess 6. At the same time, the step-shaped locking means 4 arrives in the corresponding recess 5. Thus, the panels are coupled with each other in a direction that runs perpendicular relative to the pushing direction.

Thus, a channel is created that is formed by the locking means of the two panels 1 and 2. A securing pin 11 is pushed into this channel. The panels 1 and 2 are now interlocked in a positive fit, namely in particular perpendicular relative to the surface 12 of the covering thus formed, as well as perpendicular relative to the joint 13 and, at the same time, parallel relative to it, as FIG. 1*c* illustrates. Thus, the two directions along the arrows 7 and 10, which are of particular importance in floor coverings, are very stably interlocked.

For reasons that were already mentioned, the securing pin 11 has a rectangular cross-section. As a whole, this connection can only be undone by destroying it as long as the securing pin is not pulled out. If a panel is connected to further panels on all four sides, the securing pin cannot be pulled out anymore.

The particularly stable interlock in the two aforementioned spatial directions is obtained because locking means are provided that are formed substantially step-shaped, each of which provide locking surfaces that run perpendicular to the direction of the arrows. With regard to the interlock perpendicular to the surface 12, i.e. along the arrow 7, it is an additional particular advantage that the step 3 interlocks in the recess 6, on the one side, and the step 4 interlocks in the recess 5 on the other side. This results in a connection between the panels that has a good mechanical stressability. The two protruding groove walls 8 and 9 cannot be deflected towards the outside anymore.

The geometries of the connecting means according to the FIGS. 1*a* to 1*c* are simple. Fragile geometries that are difficult to manufacture and that, furthermore, can break easily, are advantageously avoided.

The lowermost step, respectively, in the step-shaped locking elements tapers slightly. The corresponding recess opens correspondingly. This facilitates the pushing along the arrow 10.

Advantageously, the securing pin 11 tapers towards at least one end, so that it can be easily inserted into the channel.

Figure 2:
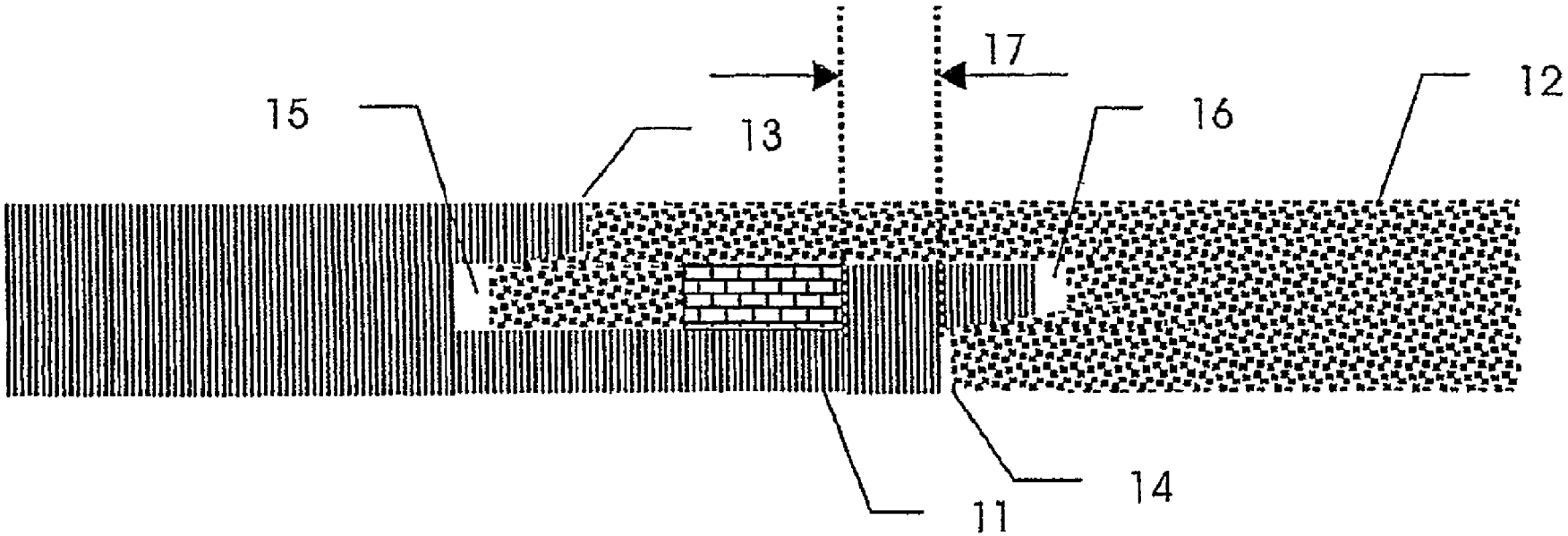
FIG. 2 illustrates a second embodiment with shortened steps.

The embodiment shown in FIG. 2 differs from the embodiment 1 by shortened steps, so that gaps 15 and 16 remain in the locked state. This ensures in an improved manner that the joint 13 that is present on the surface having the décor remains closed, and that neither production imprecision nor expansion and shrinking phenomena are able to change anything in this regard.

The counterpart of the joint 13 on the underside is advantageously formed by a gap 14 in order to contribute to the joint 13 on the surface remaining closed reliably.

The advantages of the connections shown in FIGS. 1 and 2 are:

- Permanent vertical and horizontal interlock,
- Highest extraction resistance in horizontal direction, controllable by means of the geometry, namely in particular through the width 17, shown in FIG. 2,
- Easy to mill,
- Strong groove walls or flanks possible, high abutment accuracy (no turning upwards)
- Simple application, unproblematic laying,
- Unintentional giving way of the second groove wall or flank 8 impossible due to the second groove and tongue, or the second step-shaped locking means 4, with corresponding recess 5,
- The connection can be tightened easily due to the securing pin,
- The securing pin can easily be packed together with the panels,
- The panels 1 and 2 can be separated from each other and laid again.

The connections shown in FIGS. 1 and 2 are advantageously only provided at the narrow sides of the panels. In that case, the long sides preferably have such locking elements as can connected with each other by turning. For the reasons mentioned at the beginning, laying is done particularly fast and easily because the pushing motions in the direction of the arrow 10 that are still necessary are minimal. In particular, the pushing motion is negligibly small compared to the pushing distances that are necessary in the pushing solutions mentioned at the beginning.

Figure 3:
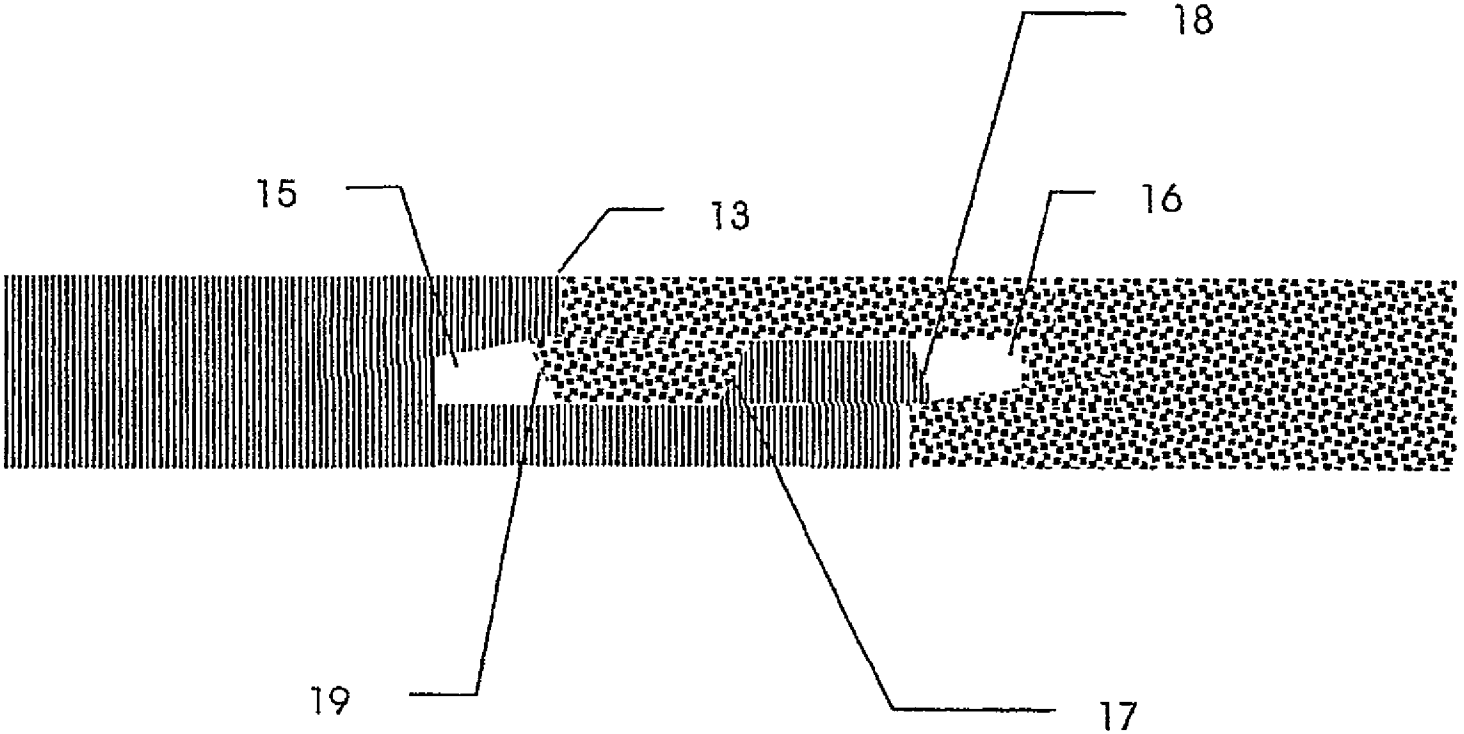
FIG. 3 illustrates an embodiment without a locking pin.

FIG. 3 shows an embodiment without securing pin 11 in which an interlock is obtained solely by lowering and subsequent minimal pushing. Here it is required that the respective lowermost step is formed relatively short in order to be able to connect the panels by a lowering motion. In that case, it is necessary that the protruding flanks are sufficiently elastic. Furthermore, slants 17, 18 and 19 are advantageously provided that facilitate connecting when the one panel is lowered in relation to the other.

Figure 4A:
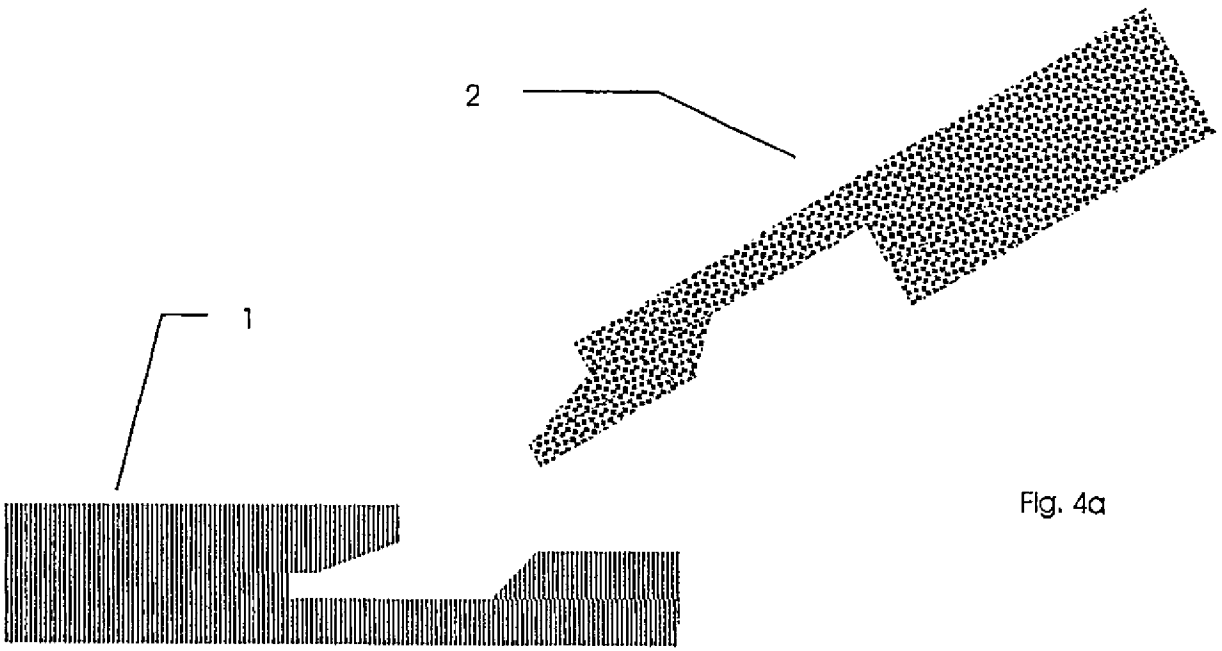
FIG. 4*a* illustrates an embodiment with a turning solution.
Figure 4B:
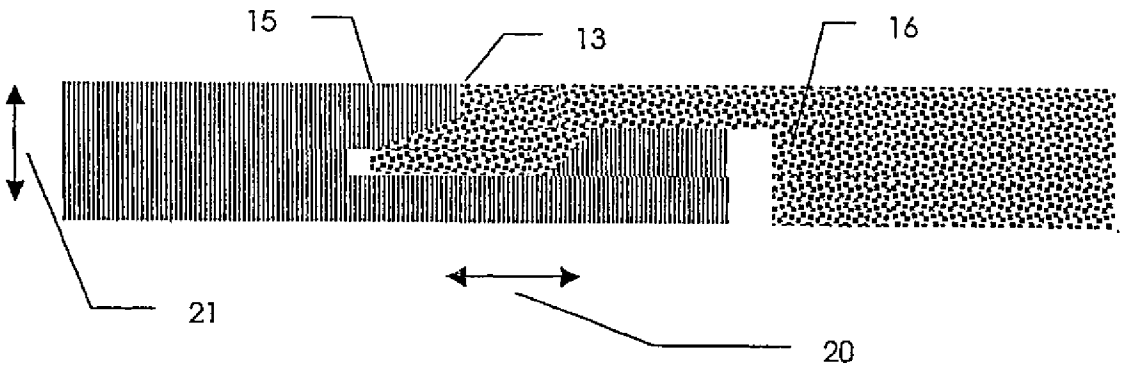
FIG. 4*b* illustrates an embodiment with a turning solution.

The FIGS. 4*a* and 4*b* show an example for a turning solution. Coming from above at an oblique angle, a panel 2 is guided towards the panel 1 in a suitable manner and is then brought from the oblique position into the common panel plane according to FIG. 4*b* by a kind of rotating or turning motion. Thus, the two panels 1 and 2 are interlocked in the two directions 20 and 21 that are of particular importance in floor coverings.

Preferably, the connecting means that are connected with each other by turning are designed and dimensioned so that the panels can only be separated by destroying the connecting means when they are pulled apart parallel to the surface of the flooring, i.e. parallel to the double arrow 20. Therefore, there is no danger that panels 1 and 2 can separate in a flooring.

The invention claimed is:

1. Connecting means made in such a way that one said connecting means can be connected with the other connecting means in a positive fit in two directions that are perpendicular relative to each other, and wherein said one and other connecting means are formed by respective panel edges that have the same geometry, and each panel edge has a uniform cross-sectional portion bounded by top and bottom surfaces of the panels and a profiled cross-sectional portion extending from the uniform cross-sectional portion, each profiled portion having the same geometry but inverted with respect to one another.

2. Connecting means according to claim 1, wherein the profiled cross-sectional portions are configured so that they can be connected by lowering the one connecting means relative to the other connecting means and then pushing the connecting means towards each other in a direction perpendicular relative to the lowering motion.

3. Connecting means according to claim 1, comprising a separate locking means inserted between the panel edges after the panel edges have been connected together for locking the panel edges in such connected state.

4. Connecting means according to claim 3, wherein the connecting means is step-shaped or stair-shaped.

5. Connecting means according to claim 1, comprising a separate locking means which can be pushed into a channel formed between the panel edges, wherein at least one external dimension of the separate locking means is greater than the corresponding internal dimension of the channel, so that the separate locking means can be held in the channel by press fit and the separate locking means consists of a compressible material such as plastics.

6. Panels with connecting means provided laterally according to claim 1, which are formed in particular as laminate flooring panels comprising a base board and a decorative layer.

7. Panels of rectangular shape having lateral connecting elements provided along lateral edges of the panels, which lateral connecting elements are configured to be connected with each other with a positive fit in two directions that are perpendicular relative to each other, and longitudinal connecting elements provided along longitudinal edges of the panels, which longitudinal connecting elements are configured to be connected with each other by a turning motion, and wherein said lateral connecting elements are formed by respective panel edges that have the same geometry, and each panel edge has a uniform cross-sectional portion bounded by top and bottom surfaces of the panels and a profiled cross-sectional portion extending from the uniform cross-sectional portion, each profiled portion having the same geometry but inverted with respect to one another.

8. Panels according to claim 7, wherein the lateral connecting elements are configured so that they can be connected by lowering the one connecting element relative to the other connecting element and then pushing the connecting elements towards each other in a direction perpendicular relative to the lowering motion.

9. Panels according to claim 7, including a locking device insertable into a space between the lateral connecting elements when coupled together to lock the lateral connecting elements against separation.

10. Panels according to claim 9, wherein the locking device has a substantially rectangular cross-section.

11. Panels according to claim 7, wherein the lateral connecting elements are step-shaped.

12. Panels according to claim 7, including a separate locking device that can be pushed into a channel formed by the lateral connecting elements when coupled together, wherein at least one external dimension of the separate locking device is greater than the corresponding internal dimension of the channel, so that the separate locking device can be held in the channel by press fit and the separate locking device and/or the lateral locking elements is/are made of a compressible material.

13. Panels according to claim 7, wherein panels are formed as laminate flooring panels including a base board and a decorative layer.

14. A panel of rectangular shape having first and second lateral connecting elements provided along respective first and second lateral edges of the panel, which first and second lateral connecting elements are configured to be connected respectively with like second and first lateral connecting elements of adjacent panels with a positive fit in two directions that are perpendicular relative to each other, and first and second longitudinal connecting elements provided along respective first and second longitudinal edges of the panel, which first and second longitudinal connecting elements are configured to be connected respectively with like second and first longitudinal connecting elements of adjacent panels by a turning motion, and wherein said first and second lateral connecting elements are formed by respective panel edges that have the same geometry, and each panel edge has a uniform cross-sectional portion bounded by top and bottom surfaces of the panels and a profiled cross-sectional portion extending from the uniform cross-sectional portion, each profiled portion having the same geometry but inverted with respect to one another.

15. Connecting means according to claim 3, wherein the separate locking means is a securing pin.

* * * * *